US008708444B2

(12) United States Patent
Shimizu

(10) Patent No.: US 8,708,444 B2
(45) Date of Patent: Apr. 29, 2014

(54) INKJET PRINTER AND EJECTION TIMING CORRECTION METHOD

(75) Inventor: Keigo Shimizu, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 201 days.

(21) Appl. No.: 13/426,345

(22) Filed: Mar. 21, 2012

(65) Prior Publication Data

US 2012/0249644 A1 Oct. 4, 2012

(30) Foreign Application Priority Data

Mar. 28, 2011 (JP) ..... P2011-70616

(51) Int. Cl.
*B41J 29/38* (2006.01)

(52) U.S. Cl.
USPC ..... 347/13; 347/19

(58) Field of Classification Search
CPC ..... B41J 2/04573; B41J 2/155; B41J 2/2146
USPC ..... 347/13, 19, 42
See application file for complete search history.

(56) References Cited

U.S. PATENT DOCUMENTS 7,780,275 B2 * 8/2010 Kusunoki ..... 347/77
2005/0073539 A1 * 4/2005 McGarry et al. ..... 347/14

FOREIGN PATENT DOCUMENTS

JP 2006-88342 4/2006

* cited by examiner

*Primary Examiner* — Julian Huffman
*Assistant Examiner* — Sharon A Polk
(74) *Attorney, Agent, or Firm* — McDermott Will & Emery LLP

(57) ABSTRACT

A head includes first and second outlet rows, and records uniform images in check regions. In each uniform image, a combination of a first dot row formed with the first outlet row and a second dot row formed with the second outlet row while being spaced apart from the first dot row in a movement direction is repeatedly arranged with a repeat pitch in its direction. When recording the uniform image in each check region, a distance obtained by changing a reference distance, which is half the repeat pitch, by a set shift amount is assigned as a distance between each first dot row and each second dot row, the set shift amount being progressively changed for the check regions. A maximum density check region is specified, and ejection timing of the second outlet row is corrected based on the set shift amount corresponding to the maximum density check region.

12 Claims, 7 Drawing Sheets

INKJET PRINTER AND EJECTION TIMING CORRECTION METHOD

TECHNICAL FIELD

The present invention relates to an inkjet printer and a method for correcting the timing of ink ejection by the inkjet printer.

BACKGROUND ART

Inkjet printers that record images by ejecting fine droplets of ink toward a base material from a plurality of outlets of a head while moving the base material relative to the head are conventionally used. Japanese Patent Application Laid-Open No. 2006-88342 discloses a technique in which, even if the landing position of ink ejected from a certain nozzle is shifted in the direction of arrangement of nozzles (the direction orthogonal to the feed direction of recording paper) due to a processing error in the nozzle or the like, the shift in the landing position is corrected by supplying one of five types of driving signals, each indicating different ejection timing, to an actuator while moving the inkjet head in the direction parallel to the direction of arrangement of nozzles, and thereby causing the nozzle whose ink landing position is shifted to have different ink ejection timing from other nozzles.

Furthermore, inkjet printers that include a first outlet row and a second outlet row arranged in a predetermined movement direction have also come into practical use, in which each outlet row has a plurality of outlets arranged with a fixed outlet pitch in a width direction perpendicular to the movement direction, and each outlet in the second outlet row is disposed halfway between each pair of adjacent outlets in the first outlet row with respect to the width direction. With such inkjet printers, although the outlets in each outlet row are spaced relatively far apart from one another, adjusting the ejection timing of the second outlet row with respect to that of the first outlet row allows the first outlet row and the second outlet row to form, with a fine pitch (i.e., at a high recording resolution), a plurality of dots arranged in a row in the width direction at each position in the movement direction.

Incidentally, in the inkjet printers including the first outlet row and the second outlet row, the ejection timing of the second outlet row with respect to that of the first outlet row is ideally determined based on the space in the movement direction between the first outlet row and the second outlet row and the relative movement speed of the head and the base material. However, in actuality, the characteristics of ink ejection (e.g., the direction and speed of ink ejection) vary depending on each outlet row, and thus the ejection timing of the second outlet row with respect to that of the first outlet row needs to be adjusted individually. If the ejection timing is not appropriately adjusted, dots formed with the first outlet row and dots formed with the second outlet row are spaced apart from one another in the movement direction, as a result of which the quality of images to be recorded is degraded. The ejection timing can be corrected by, for example, recording a predetermined test pattern on a base material and observing the test pattern under a loupe or a microscope, but this requires complex operations and a long time to correct the ejection timing.

SUMMARY OF INVENTION

The present invention is intended for an inkjet printer, and it is an object of the present invention to easily correct ejection timing.

The inkjet printer according to the present invention includes a head that ejects fine droplets of ink toward a base material, a movement mechanism that moves the base material in a predetermined movement direction relative to the head, and a control part that controls ink ejection from the head. The head includes a first outlet row and a second outlet row, each including a plurality of outlets arranged with a fixed outlet pitch in a direction that intersects the movement direction, the first outlet row and the second outlet row being arranged in the movement direction. Each outlet in the second outlet row is disposed between each pair of adjacent outlets in the first outlet row with respect to a width direction perpendicular to the movement direction. Uniform images are recorded in a plurality of check regions, each being a region of a predetermined size on the base material, under control of the control part. Assuming that a plurality of dots arranged in the width direction is taken as a dot row in the uniform image in each check region, a combination of a first dot row formed with the first outlet row and a second dot row formed with the second outlet row while being spaced apart from the first dot row in the movement direction is repeatedly arranged with a fixed pitch in the movement direction. When the uniform image is recorded in each check region, a distance that is obtained by changing a reference distance, which is half the pitch, by a set shift amount is assigned as a distance between the first dot row and the second dot row by the control part, the set shift amount being progressively changed for the plurality of check regions. In the plurality of check regions, an overlapping area of the first dot row and the second dot row varies depending on an actual shift amount of a distance between the first dot row and the second dot row from the reference distance. The control part includes an input receiving part and an ejection timing correction part, the input receiving part receiving an input signal for specifying a maximum density check region that has a maximum dot area rate in the uniform image out of the plurality of check regions, and the ejection timing correction part correcting ejection timing of the second outlet row with respect to ejection timing of the first outlet row, based on a set shift amount corresponding to the maximum density check region.

According to the present invention, the ejection timing can be easily corrected.

According to a preferred embodiment of the present invention, the inkjet printer further includes a density measurement part that measures densities of the plurality of check regions, and a region specification part that specifies the maximum density check region based on a measurement result from the density measurement part. The input receiving part receives a signal indicating the maximum density check region as the input signal, from the region specification part. This enables automatic correction of the ejection timing.

According to another preferred embodiment of the present invention, the head further includes a third outlet row that is arranged together with the first outlet row and the second outlet row in the movement direction. Each outlet in the second outlet row and each outlet in the third outlet row are disposed between each pair of adjacent outlets in the first outlet row with respect to the width direction. A shortest distance in the width direction between each outlet in the third outlet row and each outlet in the first outlet row is greater than a shortest distance in the width direction between each outlet in the second outlet row and each outlet in the first outlet row. The control part records uniform images in another plurality of check regions with the second outlet row and the third outlet row in the same manner as in the plurality of check regions. The input receiving part receives an input signal for specifying another maximum density check region out of the other plurality of check regions. The ejection timing correction part corrects ejection timing of the third outlet row with respect to ejection timing of the first outlet row, based on the set shift amount corresponding to the maximum density check region and a set shift amount corresponding to the other maximum density check region. Accordingly, even if each outlet in the first outlet row and each outlet in the third outlet row are spaced far apart from each other in the width direction, the ejection timing of the third outlet row with respect to that of the first outlet row can be corrected with high accuracy.

According to yet another preferred embodiment of the present invention, the inkjet printer includes a plurality of heads that include the head and are arranged across the base material in the width direction, the plurality of heads each having the same configuration as the head. The input receiving part receives the input signal for each head, and the ejection timing correction part corrects the ejection timing of the second outlet row for each head.

The present invention is also intended for an ejection timing correction method used in an inkjet printer including a first outlet row and a second outlet row that are arranged in a predetermined movement direction, for correcting ejection timing of the second outlet row with respect to ejection timing of the first outlet row.

These and other objects, features, aspects and advantages of the present invention will become more apparent from the following detailed description of the present invention when taken in conjunction with the accompanying drawings.

DESCRIPTION OF EMBODIMENTS

Figure 1:
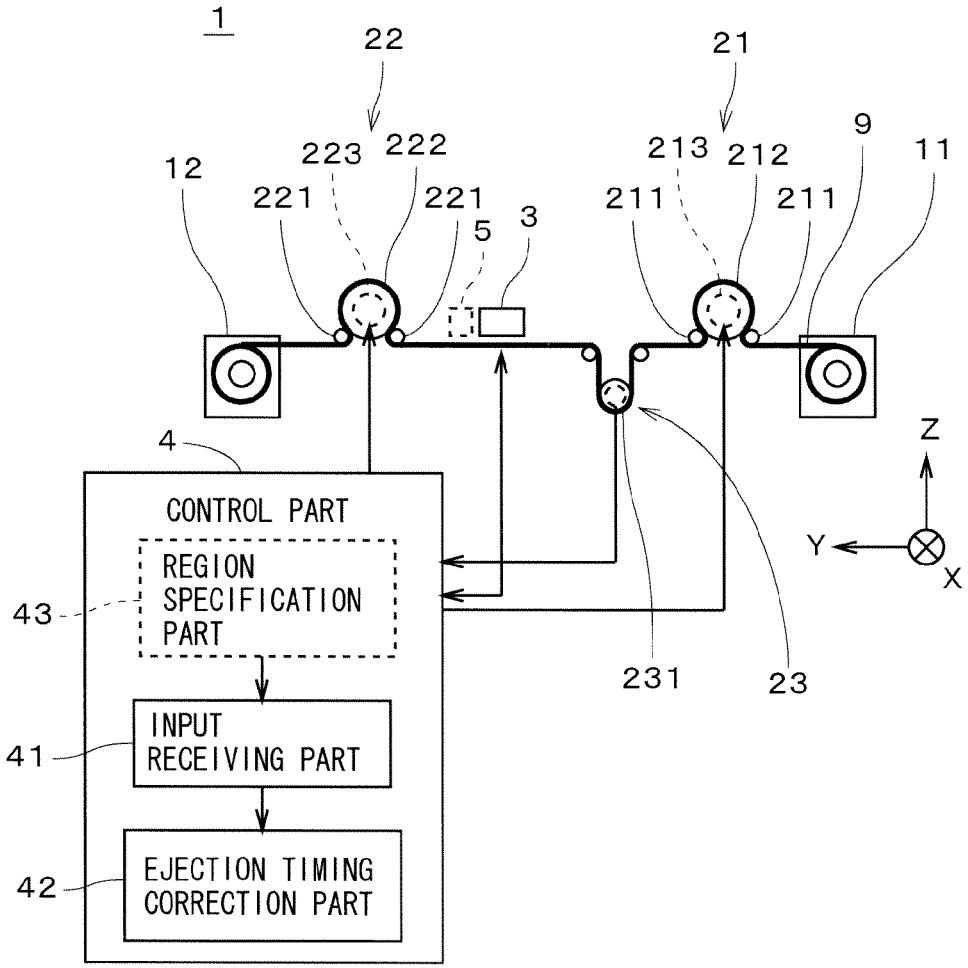
FIG. 1 shows a configuration of an inkjet printer.

FIG. 1 shows a configuration of an inkjet printer 1 according to an embodiment of the present invention, and the inkjet printer 1 prints (records) an image on a band-like base material 9. Examples of the material for the base material 9 include paper, a resin film, and a thin metal plate.

The inkjet printer 1 includes a storage part 11 that stores a pre-printing base material 9 in the form of a roll, a first motor part 21 that draws the base material 9 out of the storage part 11, an encoder 23 that detects the movement speed of the base material 9 based on rotation of a roller 231 abutting the base material 9, a head unit 3 that ejects fine droplets of ink toward one main surface of the base material 9, a second motor part 22 that draws the base material 9 located below the head unit 3 (on the (−Z) side in FIG. 1), a collection part 12 that collects the printed base material 9 in the form of a roll, and a control part 4 that controls the overall operations of the inkjet printer 1. The control part 4 includes an input receiving part 41 that receives an input signal input by an operator through an input unit (not shown), and an ejection timing correction part 42 that corrects ejection timing of an outlet row, which will be discussed later. Note that a density measurement part 5 and a region specification part 43, both indicated by broken lines in FIG. 1, are used in an exemplary operation described later.

The first motor part 21 includes a main roller 212 that conveys the base material 9 wound around the outer surface of the main roller 212 by auxiliary rollers 211, and a motor 213 that rotates the main roller 212. Similarly, the second motor part 22 includes a main roller 222 that conveys the base material 9 wound around the outer surface of the main roller 222 by auxiliary rollers 221, and a motor 223 that rotates the main roller 222.

In the inkjet printer 1, the control part 4 adjusts the rotation speeds of the first motor part 21 and the second motor part 22 based on the movement speed of the base material 9 acquired by the encoder 23 and the tension of the base material 9 detected by a tension detection mechanism (not shown), so that the tension and movement speed of the base material 9 are kept substantially constant. In the following description, the Y direction in FIG. 1, which is the direction of movement of the base material 9 located below the head unit 3, is simply referred to as a "movement direction".

Figure 2:
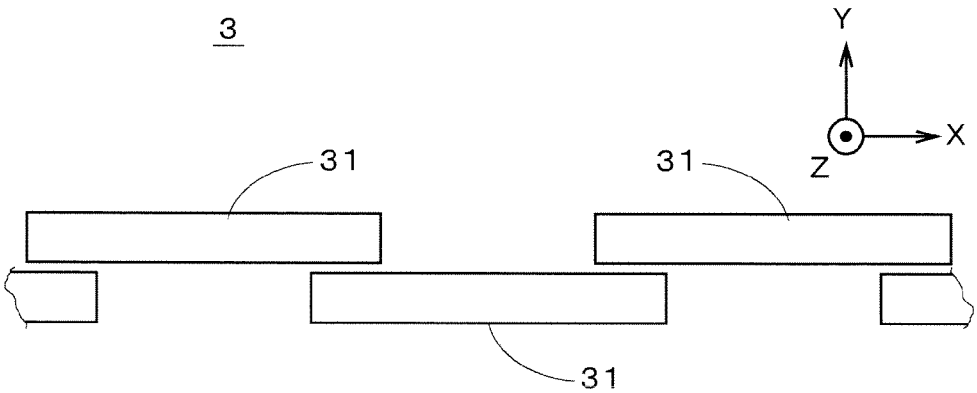
FIG. 2 is a plan view of a head unit.

FIG. 2 is a plan view showing part of the head unit 3. In FIG. 2, the head unit 3 is shown taking the movement direction in FIG. 1 as the vertical direction. As shown in FIG. 1, the normal direction of the main surface of the base material 9 is parallel to the Z direction below the head unit 3 (on the (−Z) side). In the head unit 3 in FIG. 2, a plurality of heads 31 having the same configuration are arranged in a staggered manner along the X direction perpendicular to both the movement direction and the normal direction of the main surface (which is the direction corresponding to the width of the base material 9 and hereinafter referred to as a "width direction"). In actuality, the plurality of heads 31 are arranged across the entire width of the base material 9 in the width direction and realize so-called one-pass (single-pass) printing in which printing is completed in one pass of the base material 9 under the head unit 3.

Figure 3:
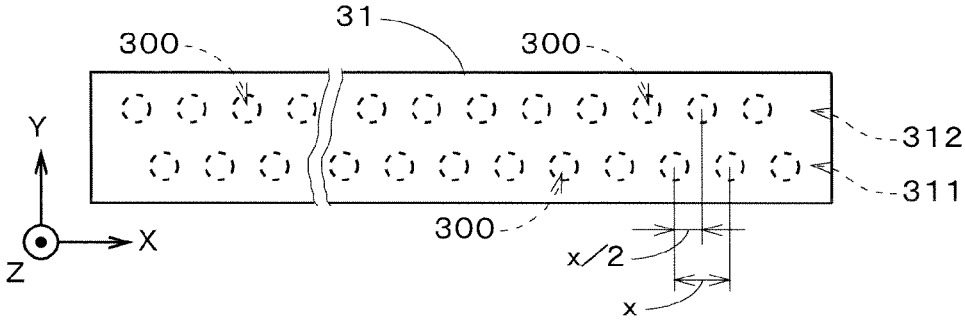
FIG. 3 is a plan view of heads.

FIG. 3 is a plan view showing one of the heads 31. As shown in FIG. 3, each head 31 includes a first outlet row 311 and a second outlet row 312 and each of the outlet rows 311 and 312 is a group consisting of a plurality of outlets 300 arranged with a fixed pitch x (which is hereinafter referred to as an "outlet pitch x") in the width direction (X direction). The first and second outlet rows 311 and 312 are arranged in the movement direction (Y direction), and each outlet 300 in the second outlet row 312 on the (+Y) side is disposed halfway (in the middle) between each pair of adjacent outlets 300 in the first outlet row 311 on the (−Y) side, with respect to the width direction. In other words, with the head 31 as a whole, the plurality of outlets 300 are arranged with a pitch that is half the outlet pitch x in the width direction. The plurality of outlets 300 in the head 31 are disposed on the same plane, which is parallel to the main surface of the base material 9 below the head unit 3 (i.e., the plane parallel to the XY plane).

In an image recording operation performed by the inkjet printer 1 in FIG. 1, the control part 4 performs ink ejection control on each head 31 in parallel with continuous movement of the base material 9 in the movement direction. Specifically, every time the base material 9 is moved by a fixed distance, the control part 4 generates an ejection pulse signal based on the signal from the encoder 23, and ink is ejected from the respective outlet rows 311 and 312 after individual amounts of delay from the generation of the ejection pulse signal.

Figure 4:
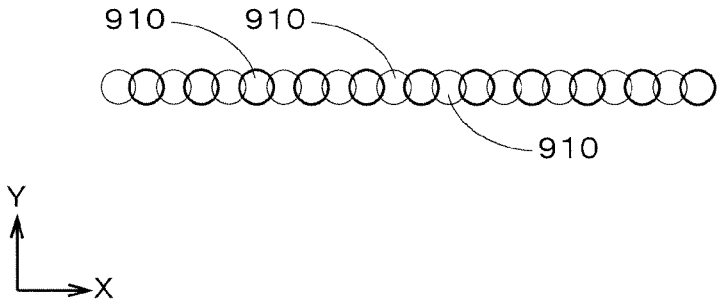
FIGS. 4 and 5 show dots on a base material.

In this case, ideal image recording is, as shown in FIG. 4, such that dots 910 formed with the first outlet row 311 of the head 31 (which are indicated by thin circles in FIG. 4; the same applies to FIG. 5 described later and FIGS. 7 to 11) and dots 910 formed with the second outlet row 312 (which are indicated by bold circles in FIG. 4; the same applies to FIG. 5 described later and FIGS. 7 to 11) are disposed at the same position in the movement direction. In other words, delay amounts for causing the dots 910 formed with the first outlet row 311 and the dots 910 formed with the second outlet row 312 to be formed at the same position in the movement direction are set for the first outlet row 311 and the second outlet row 312. As described previously, since each outlet 300 in the second outlet row 312 is disposed halfway between each pair of adjacent outlets 300 in the first outlet row 311 with respect to the width direction, in the ideal image recording, the dots 910 formed with the outlets 300 in the first outlet row 311 and the dots 910 formed with the outlets 300 in the second outlet row 312 are alternately arranged on a straight line extending in the width direction.

Figure 5:
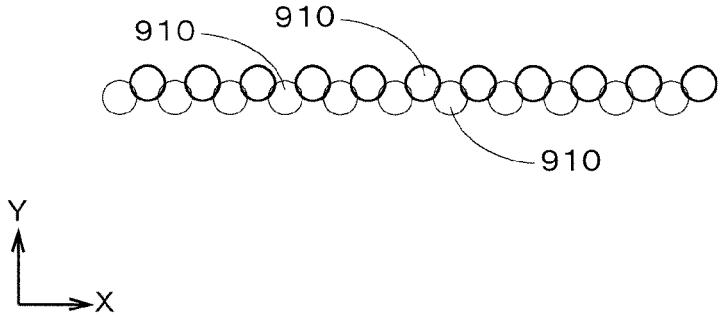

On the other hand, if appropriate delay amounts are not set for the first outlet row 311 and the second outlet row 312, the dots 910 formed with the first outlet row 311 and the dots 910 formed with the second outlet row 312 will be slightly spaced apart from one another in the movement direction as shown in FIG. 5, and the resultant image will have jagged edges.

Hereinafter, processing for obtaining delay amounts for causing the first outlet row 311 and the second outlet row 312 to form dots at the same position in the movement direction, that is, for correcting ejection timing of the downstream second outlet row 312 with respect to that of the upstream first outlet row 311 with respect to the direction of movement of the base material 9 relative to the head 31 (this processing is hereinafter referred to as "ejection timing correction processing") will be described with reference to FIG. 6. Note that the ejection timing correction processing is performed, for example, immediately after assembly of the inkjet printer 1 or immediately after replacement for a disabled head.

In the ejection timing correction processing, the first motor part 21 and the second motor part 22 shown in FIG. 1 are turned on first, upon which continuous movement of the base material 9 in the movement direction is started (step S11). The control part 4 controls ink ejection from the heads 31 according to a predetermined rule in parallel with the movement of the base material 9, and images are recorded in a plurality of check regions, each being a region of a predetermined size on the base material 9 (step S12). As will be described later, images having uniform densities are recorded in the respective entire check regions, and thus the images to be recorded in the check regions are hereinafter referred to as "uniform images".

FIGS. 7 to 11 are diagrams illustrating the recording of uniform images in a plurality of check regions, the left side in FIGS. 7 to 11 showing part of the check regions 91 on the base material 9 prior to the recording of uniform images and the right side therein showing part of the check regions 91 after the recording of uniform images. On the left and right sides in FIGS. 7 to 11, a plurality of square regions 90 arranged with an element pitch P in both the width direction (X direction) and the movement direction (Y direction) are indicated by thin lines, the element pitch P being equivalent to the smallest variable unit of the delay amount.

When uniform images are recorded in the plurality of check regions 91, a plurality of positions arranged with an outlet pitch x in the width direction and a predetermined repeat pitch y (see FIG. 7) in the movement direction are assigned as positions 921 where dots are to be formed with the first outlet row 311 (which are positions indicated by diagonal hatched rectangles on the left side in FIGS. 7 to 11 and hereinafter referred to as "first assigned positions"). Furthermore, a plurality of positions obtained by moving the plurality of first assigned positions 921 by dx parallel to the width direction and by (y/2+dy) (see FIG. 7) parallel to the movement direction are assigned as positions 922 where dots are to be formed with the second outlet row 312 (which are positions indicated by bold rectangles on the left side in FIGS. 7 to 11 and hereinafter referred to as "second assigned positions").

In the present embodiment, as shown on the left side in FIGS. 7 to 11, the outlet pitch x is equal to eight times the element pitch P, and the repeat pitch y is equal to six times the element pitch P. Furthermore, dx is half the outlet pitch x (four times the element pitch P) because each outlet 300 in the second outlet row 312 is disposed halfway between each pair of adjacent outlets 300 in the first outlet row 311 with respect to the width direction.

Figure 7:
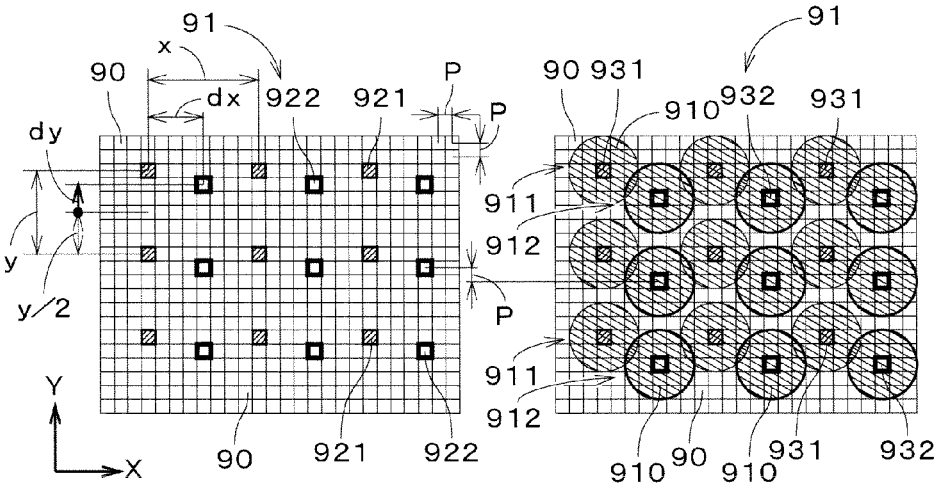
FIGS. 7 through 11 are diagrams illustrating recording of uniform images in check regions.

As described previously, since the second assigned positions 922 are spaced from the first assigned positions 921 by (y/2+dy) in the movement direction, a shift amount of the second assigned positions 922 from the first assigned position 921 in the movement direction is assigned as a distance that is obtained by changing a reference distance, which is half the repeat pitch y, by a set shift amount dy (which is indicated by the bold arrow on only the left side in FIG. 7). The set shift amount dy is progressively changed for the plurality of check regions 91, and the set shift amounts dy on the left side in FIGS. 7 to 11 are respectively (+2) times, (+1) times, 0 times, (−1) times, and (−2) times the element pitch P, taking the direction from the (−Y) side to the (+Y) side as the positive direction.

Figure 9:
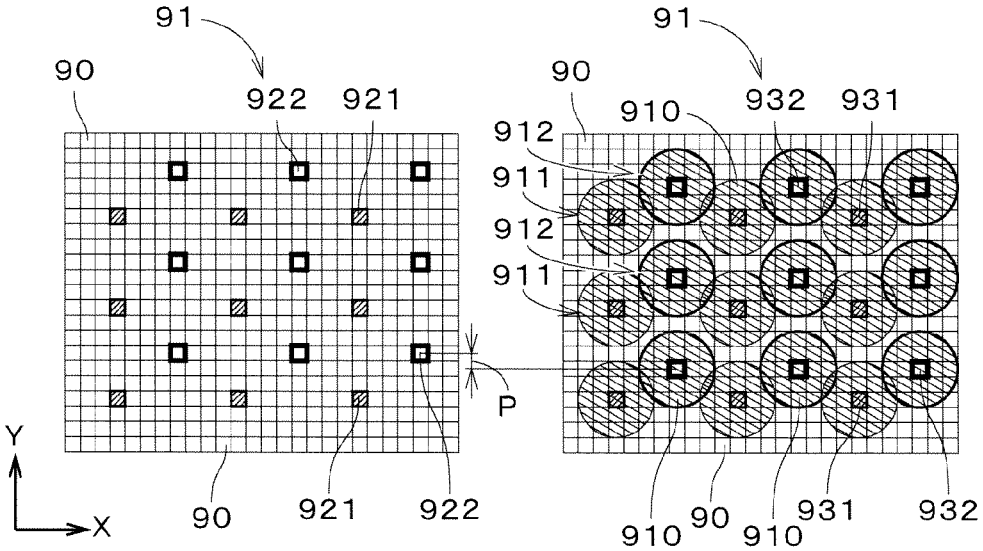
Figure 10:
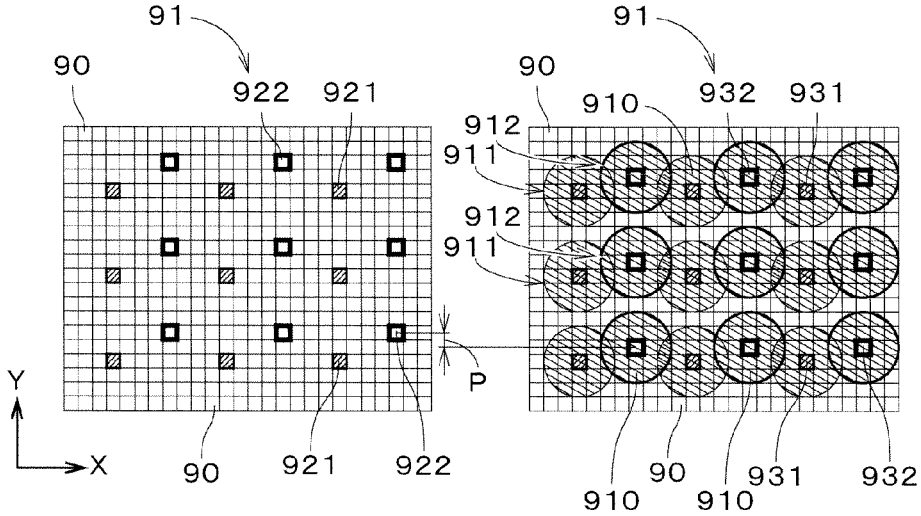
Figure 11:
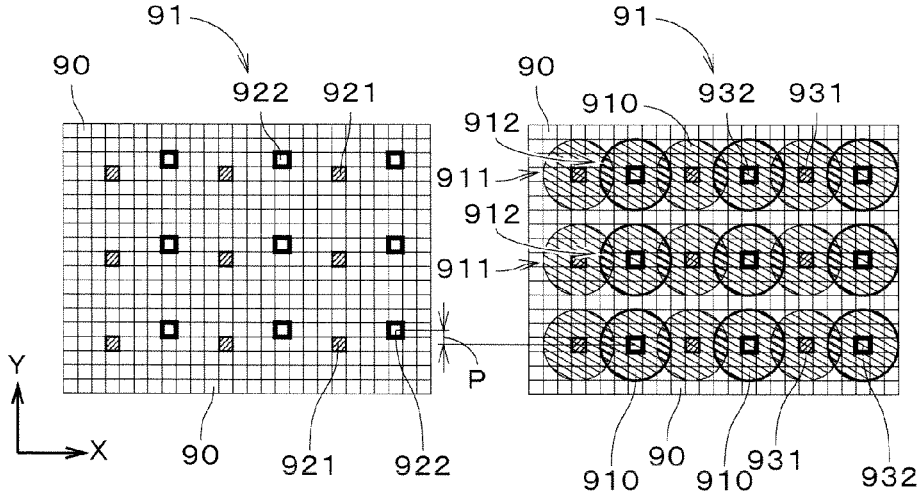

As shown on the left side in FIG. 9, in the case where the set shift amount dy is 0 times the element pitch P, each second assigned position 922 is disposed halfway between each pair of adjacent first assigned positions 921 with respect to the movement direction, and the shortest distance between each second assigned position 922 and each first assigned position 921 becomes a maximum. Note that the repeat pitch y and the set shift amount dy may be appropriately changed.

Using the initial values for the delay amounts that have been set in advance for the first outlet row 311 and the second outlet row 312 of each head 31, the control part 4 performs ink ejection control to cause the first outlet row 311 to form dots at a plurality of first assigned positions 921 in each check region 91 and cause the second outlet row 312 to form dots at a plurality of second assigned positions 922 in the check region 91.

According to the rule shown on the left side in FIGS. 7 to 11, images having uniform patterns (i.e., uniform images) are recorded in the entire check regions 91 as shown on the right side in FIGS. 7 to 11, in each of which, assuming that a plurality of dots 910 arranged in the width direction are taken as a dot row, a combination of a first dot row 911 formed with the first outlet row 311 and a second dot row 912 formed with the second outlet row 312 while being spaced apart from the first dot row 911 in the movement direction is repeatedly arranged with the fixed repeat pitch y in the movement direction. Furthermore, the set shift amount dy that is progressively changed for the plurality of check regions 91 is used. When the uniform ages have been recorded in the plurality of check regions 91, the first motor part 21 and the second motor part 22 are turned off, thereby stopping the movement of the base material 9 in the movement direction (step S 13).

On the right side in FIGS. 7 to 11, the centers 931 of the dots 910 included in the first dot rows 911 (which are the landing positions of droplets and hereinafter referred to as "first landing positions") are indicated by diagonal hatched rectangles, and the centers 932 of the dots 910 included in the second dot rows 912 (which are the landing positions of droplets and hereinafter referred to as "second landing positions") are indicated by bold rectangles.

In each of FIGS. 7 to 11 the position of the array of the plurality of second landing positions 932 relative to the position of the array of the plurality of first landing positions 931 is shifted by one element pitch P to the (−Y) side from the position of the array of the plurality of second assigned positions 922 relative to the position of the array of the plurality of first assigned positions 921 (in other words, the amount of the shift of the second landing positions 932 is (−1) times the element pitch P). Accordingly, in the check region 91 on the right side in FIG. 8, out of the plurality of check regions 91, in which the assigned set shift amount dy is (+1) times the element pitch P, each second landing position 932 is disposed halfway between each pair of adjacent first landing positions 931 with respect to the movement direction, and therefore the distance between each first dot row 911 and each second dot row 912 is equal to half the repeat pitch y (i.e., the reference distance).

On the other hand, in the other check regions 91, an actual shift amount of the distance between each first dot row 911 and each second dot row 912 from the reference distance increases (that is, the shortest distance between each first dot row 911 and each second dot row 912 decreases) as the set shift amount dy deviates from (+1) times the element pitch P, and the area of regions in which the first dot rows 911 and the second dot rows 912 overlap (which is hereinafter referred to as an "overlapping area") increases. In this way, in the plurality of check regions 91, the overlapping area of the first dot rows 911 and the second dot rows 912 varies depending on the actual shift amount of the distance between each first dot row 911 and each second dot row 912 from the reference distance (i.e., depending on an amount of difference between the reference distance and a distance between each first dot row 911 and each second dot row 912). Note that although only parts of the check regions 91 are shown on the right side in FIGS. 7 to 11, a large number of dots 910 are arranged in the actual check regions 91.

Furthermore, numbers, characters, codes or the like for identifying the individual check regions 91 (which are hereinafter referred to as "identification codes") are recorded in regions adjacent to the check regions 91 in the width direction (some of the outlets in each outlet row are allocated to the recording of the identification codes). In the present embodiment, "+2", "+1", "0", "−1", and "−2" are respectively recorded as the identification codes for the check regions 91 on the right side in FIGS. 7 to 11 in which the set shift amounts dy are respectively (+2) times, (+1) times, 0 times, (−1) times, and (−2) times the element pitch P.

Next, the plurality of check regions 91 on the base material 9 are observed by an operator. In the case of the plurality of check regions 91 shown on the right side in FIGS. 7 to 11, the check region 91 on the right side in FIG. 8 in which the overlapping area of the first dot rows 911 and the second dot rows 912 is a minimum is specified as a maximum density check region having a maximum density by the operator (step S14). The maximum density check region 91 has a maximum dot area rate in the uniform image (i.e., the area rate of dots occupying the check region 91), out of the plurality of check regions 91. Note that because the plurality of check regions 91 are sequentially arranged in the movement direction in ascending or descending order of their set shift amounts dy on the base material 9 and an operator can observe the uniform images whose densities are progressively changed, the maximum density check region 91 can be easily specified. In the example shown in FIGS. 7 to 11, the check region 91 on the right side in FIG. 11 has a minimum density.

When the maximum density check region 91 has been specified, the identification code "+1" corresponding to the maximum density check region 91 is input by the operator through an input unit and is received as an input signal by the input receiving part 41 of the control part 4. At this time, in order to assist the input from the operator, entry fields for inputting the identification codes corresponding to the maximum density check regions 91 for all the heads 31 in the head unit 3 are provided in a display unit (not shown) of the control part 4, through which the operator inputs the identification codes for the respective heads 31.

The ejection timing correction part 42 specifies the maximum density check regions 91 based on the input signals. For the head 31 that records the uniform images shown on the right side in FIGS. 7 to 11, the check region 91 whose set shift amount is (+1) times the element pitch P is specified as the maximum density check region, based on the input signal indicating the identification code "+1". In this way, the input signal is a signal for allowing the ejection timing correction part 42 to specify the maximum density check region out of the plurality of check regions 91.

Figure 8:
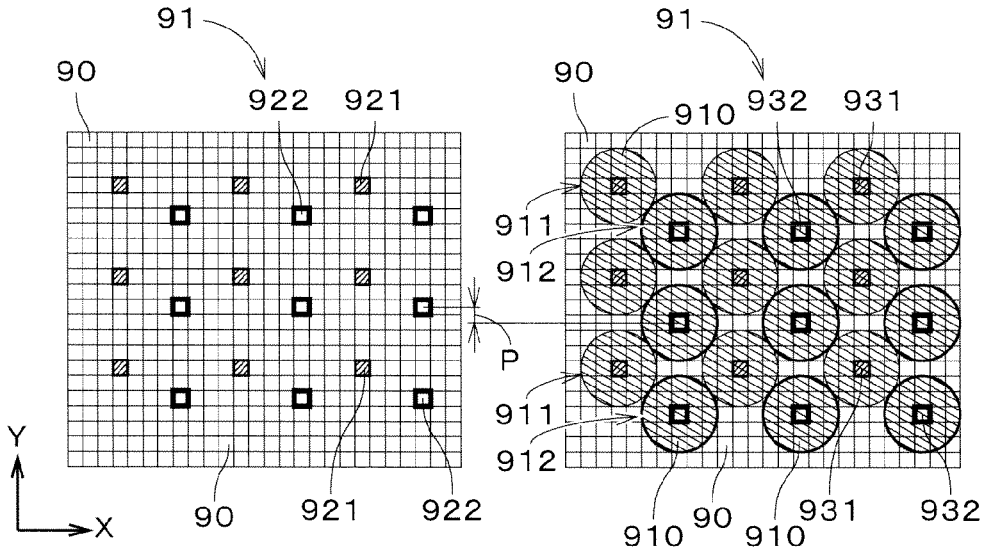

The ejection timing correction part 42 further changes the delay amount for the second outlet row 312 of that head 31 from the initial value thereof based on the set shift amount corresponding to the maximum density check region 91. Specifically, in the case of the head 31 for which the check region 91 on the right side in FIG. 8 is specified as the maximum density check region, (a value corresponding to) (+1) times the element pitch P, which is the set shift amount corresponding to the maximum density check region 91, is added to the initial value of the delay amount for the second outlet row 312, thereby changing the value of the delay amount for the second outlet row 312. As a result, the ejection timing of the second outlet row 312 with respect to that of the first outlet row 311 is corrected (step S15).

In the image recording operation using the changed delay amount, the positions of the second dot rows formed with the second outlet row 312 are shifted by one element pitch P to the (+Y) side from the position in the case of using the initial value of the delay amount. Accordingly, the dots 910 formed with the first outlet row 311 and the dots 910 formed with the second outlet row 312 are arranged at the same position in the movement direction as shown in FIG. 4.

As described above, with the inkjet printer 1, when the uniform image is recorded on each check region 91, a distance obtained by changing the reference distance, which is half the repeat pitch, by the set shift amount is assigned as the distance between each first dot row 911 and each second dot row 912 by the control part 4, and uniform images are recorded in a plurality of check regions 91 using the set shift amount that is progressively changed for these check regions. With such a plurality of check regions 91, the operator can easily specify the maximum density check region through visual observation without using a loupe or a microscope. When the maximum density check region has been specified, the identification code of the maximum density check region is input by the operator, and the input receiving part 41 receives the identification code as the input signal. The ejection timing correction part 42 specifies the maximum density check region from the identification code and corrects the ejection timing of the second outlet row 312 with respect to that of the first outlet row 311 based on the set shift amount corresponding to the maximum density check region. As a result, the inkjet printer 1 can realize high-precision ejection timing correction with ease and in a short time.

Furthermore, with the inkjet printer 1 provided with a plurality of heads 31 arranged across the base material 9 in the width direction, the input receiving part 41 receives an input signal for each head 31, and the ejection timing correction part 42 corrects the ejection timing of the second outlet row 312 with respect to that of the first outlet row 311 for each head 31. Through this, an inkjet printer for one-pass printing, in which dots are arranged with a fine pitch, can easily and precisely correct the ejection timing. Furthermore, even if a large number of heads 31 are arranged in the inkjet printer 1, it is possible to correct the ejection timing of the large number of heads 31 in a short time.

Next is a description of another exemplary operation of the inkjet printer 1. This exemplary operation uses the density measurement part 5 and the region specification part 43 indicated by the broken lines in FIG. 1. The density measurement part 5 provided in the vicinity of the head unit 3 is, for example, a camera including a two-dimensional array of image sensors or a scanner including a one-dimensional array of image sensors arranged in the width direction.

Figure 6:
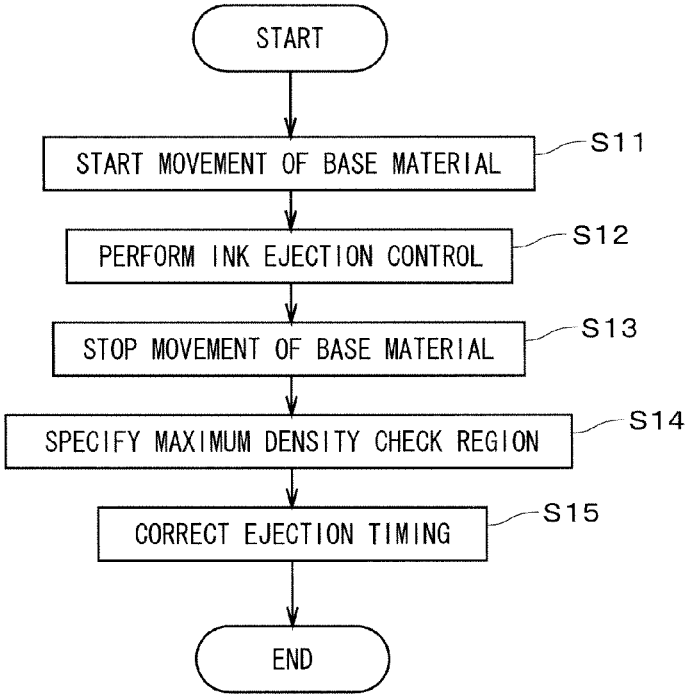
FIG. 6 shows the procedure of ejection timing correction processing.

In the inkjet printer 1, the density measurement part 5 located on the (+Y) side of the head unit 3 measures the densities (image densities) of a plurality of check regions in parallel with recording of uniform images in the check regions through the same processing as described in the above exemplary operation (FIG. 6: steps S11 to S13). The measurement result from the density measurement part 5 is input to the control part 4, and the region specification part 43 specifies the maximum density check region based on the measurement result (step S14). The input receiving part 41 receives input of a signal indicating the maximum density check region as the input signal, from the region specification part 43, and the ejection timing correction part 42 corrects the ejection timing of the second outlet row 312 with respect to that of the first outlet row 311 based on the set shift amount corresponding to the maximum density check region (step S15).

As described above, with the inkjet printer 1 including the density measurement part 5, the maximum density check region is specified based on the measurement result from the density measurement part 5. Accordingly, it is possible to automatically correct the ejection timing of the second outlet row 312 with respect to that of the first outlet row 311.

Note that in the case where the density measurement part 5 is used to measure the densities of check regions, even if a plurality of check regions are formed apart from each other, the maximum density check region can be specified with high accuracy. Furthermore, a low-cost device having low reading resolution can be used for the density measurement part 5 because it is sufficient for the density measurement part 5 to be able to only specify the densities of check regions. Moreover, the density measurement part 5 may be provided in the inkjet printer 1 only at the time of assembly of the inkjet printer 1 or at the time of replacement for a disabled head. In other words, the density measurement part 5 may be removable from the inkjet printer 1 and may be attached to the inkjet printer 1 only when performing the ejection timing correction processing. A configuration is also possible in which printing results are scanned by an independent scanner, and adjustment data is generated by a computer connected to the scanner and is then transmitted to the inkjet printer.

Figure 12:
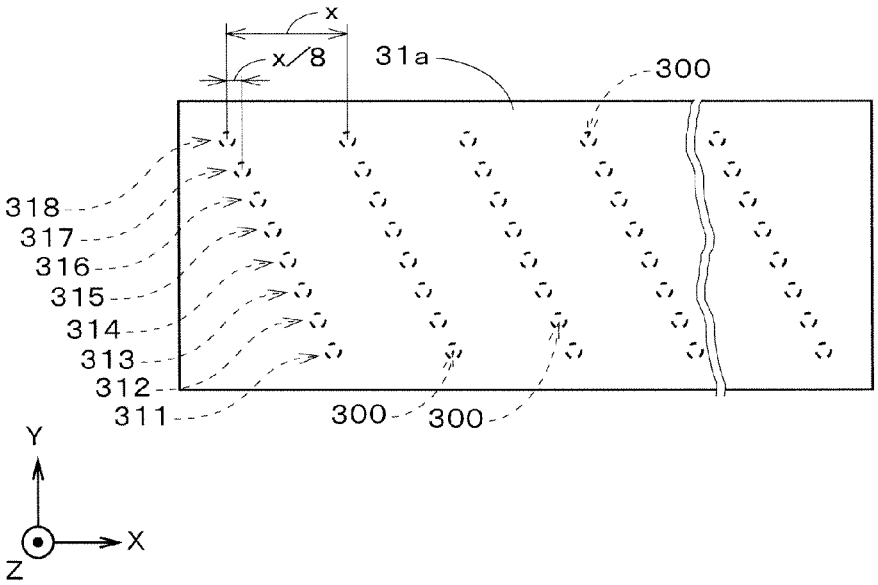
FIG. 12 is a plan view showing another example of a head.

FIG. 12 is a plan view showing another example of a head. A head 31*a* in FIG. 12 includes a plurality of (in FIG. 12, eight) outlet rows 311 to 318 arranged in the movement direction (Y direction). Each of the eight outlet rows 311 to 318 has a plurality of outlets 300 arranged with a fixed outlet pitch x in a row in the width direction (X direction). Between each pair of adjacent outlets 300 in each outlet row with respect to the width direction, seven outlets 300, one each from the other seven outlet rows, are sequentially disposed at an interval of ⅛ times the outlet pitch x.

When the ejection timing correction processing is performed with the inkjet printer 1 including the head 31*a* in FIG. 12, with the outlet row 311 on the most (−Y) side (which is hereinafter referred to as a "reference outlet row 311") as a reference, the ejection timing of each of the remaining outlet rows 312 to 318 with respect to that of the reference outlet row 311 is corrected in the same manner as in the above-described embodiment.

Specifically, uniform images are recorded in a plurality of check regions with the reference outlet row 311 and each of the other outlet rows 312 to 318 (FIG. 6: steps S11 to S13). In other words, assuming that a plurality of check regions formed with each pair of outlet rows are taken as one check region group, seven check region groups are formed. Note that, in the same manner as in the above exemplary operation, identification codes for identifying the respective check regions are recorded in regions adjacent to the check regions, and information indicating a combination of outlet rows corresponding to each check region group is also recorded in the vicinity of the corresponding check region group.

Next, the maximum density check region is specified by the operator out of the plurality of check regions recorded with the reference outlet row 311 and each of the other outlet rows 312 to 318 (step S14), and the ejection timing of each of the outlet rows 312 to 318 with respect to that of the reference outlet row 311 is corrected based on the maximum density check region (to be more precise, based on the set shift amount corresponding to the maximum density check region) (step S15). Note that the maximum density check regions may be specified by the region specification part 43 based on the measurement results from the density measurement part 5.

Figure 13:
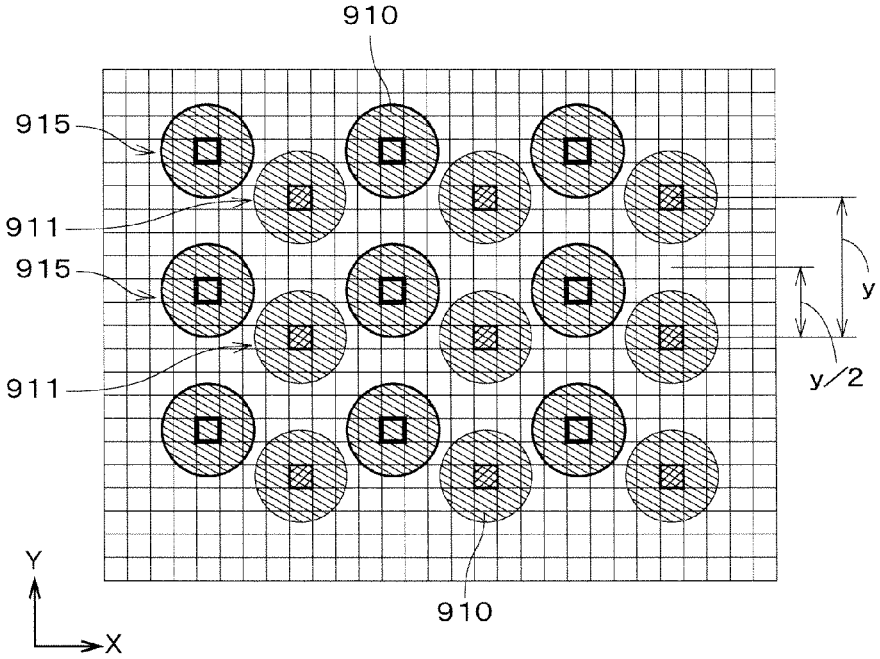
FIGS. 13 and 14 show check regions.

Incidentally, if the shortest distance in the width direction between each outlet 300 in the outlet row 315 and each outlet 300 in the reference outlet row 311 is substantially greater than or equal to the average diameter of dots, the dot rows formed with the reference outlet row 311 and the dot rows formed with the outlet row 315 hardly overlap one another in the uniform images recorded in the plurality of check regions. In this case, in spite of the fact that the distance in the movement direction between each dot row 911 formed with the reference outlet row 311 and each dot row 915 formed with the outlet row 315 is not the reference distance (y/2) (i.e., half the repeat pitch y), the overlapping area of the dot rows 911 and the dot rows 915 is substantially zero as shown in FIG. 13. Accordingly, the overlapping area of the dot rows 911 and the dot rows 915 does not vary depending on the actual shift amount of the distance between each dot row 911 and each dot row 915 from the reference distance, which makes it impossible to specify a single maximum density check region.

In such a case, another outlet row that includes outlets 300, each having a smaller shortest distance in the width direction from each outlet 300 in the reference outlet row 311 than each outlet 300 in the outlet row 315 (which is hereinafter referred to as a "target outlet row 315"), is determined as an intermediate outlet row. In the present embodiment, the outlet row 313 is determined as the intermediate outlet row, for example. Then, uniform images are recorded in a plurality of check regions with the intermediate outlet row 313 and the target outlet row 315 (steps S11 to S13).

Figure 14:
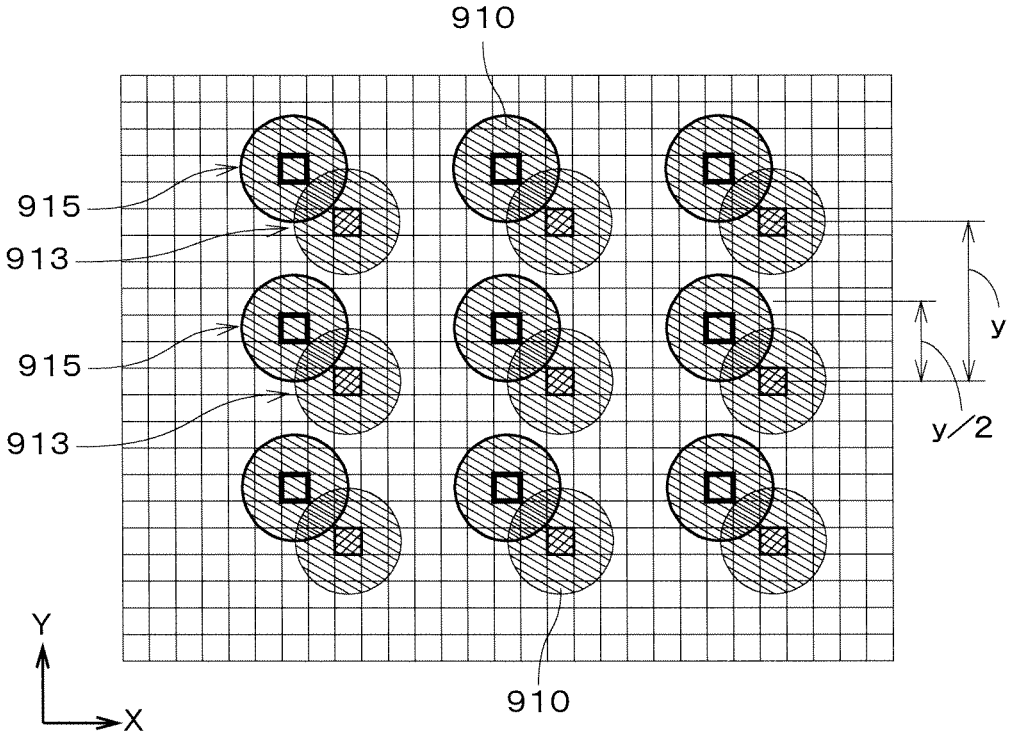

Since the shortest distance in the width direction between each outlet 300 in the intermediate outlet row 313 and each outlet 300 in the target outlet row 315 is less than the average diameter of dots, if the distance in the movement direction between each dot row 913 formed with the intermediate outlet row 313 and each dot row 915 formed with the target outlet row 315 is not the reference distance (y/2), the dot rows 913 and the dot rows 915 overlap one another as shown in FIG. 14. As a result, the overlapping area of the dot rows 913 and the dot rows 915 varies depending on the actual shift amount of the distance between each dot row 913 and each dot row 915 from the reference distance, which makes it possible to specify a single maximum density check region (step S14).

Then, a sum of the set shift amount corresponding to the maximum density check region obtained based on the intermediate outlet row 313 and the target outlet row 315 and the set shift amount corresponding to the maximum density check region obtained based on the reference outlet row 311 and the intermediate outlet row 313 is added to the initial value of the delay amount for the target outlet row 315, thereby changing the value of the delay amount for the target outlet row 315. In this way, the ejection timing of the target outlet row 315 with respect to that of the reference outlet row 311 is corrected based on a shift in the ejection timing of the intermediate outlet row 313 from that of the reference outlet row 311 and a shift in the ejection timing of the target outlet row 315 from that of the intermediate outlet row 313 (step S15). In the image recording operation using the changed delay amount, the dots formed with the reference outlet row 311 and the dots formed with the target outlet row 315 can be disposed at the same position in the movement direction.

Referring to the reference outlet row 311 as a first outlet row, the intermediate outlet row 313 as a second outlet row, and the target outlet row 315 as a third outlet row, in the head 31*a* shown in FIG. 12 in which the first to third outlet rows are arranged in the movement direction, each outlet in the second outlet row and each outlet in the third outlet row are disposed between each pair of adjacent outlets in the first outlet row with respect to the width direction. Furthermore, the shortest distance in the width direction between each outlet in the third outlet row and each outlet in the first outlet row is greater than the shortest distance in the width direction between each outlet in the second outlet row and each outlet in the first outlet row.

In the ejection timing correction processing, uniform images are recorded in another plurality of check regions with the second outlet row and the third outlet row in the same manner as in the plurality of check regions recorded with the first outlet row and the second outlet row. Then, in addition to the specification of the maximum density check region out of the plurality of check regions, another maximum density check region is also specified out of the other plurality of check regions. The input receiving part 41 receives the identification code for specifying the maximum density check region and the identification code for specifying the other maximum density check region as input signals, and the ejection timing correction part 42 corrects the ejection timing of the third outlet row with respect to that of the first outlet row based on the set shift amount corresponding to the maximum density check region and the set shift amount corresponding to the other maximum density check region. Through this, with the inkjet printer 1 provided with three or more outlet rows, even if each outlet in the first outlet row and each outlet in the third outlet row are spaced significantly apart from each other in the width direction, it is possible to correct the ejection timing of the third outlet row with respect to that of the first outlet row with high accuracy.

While the above has been a description of the embodiments of the present invention, the present invention is not intended to be limited to the above-described embodiments, and various modifications are possible.

On the left side in FIGS. 7 to 11, since the repeat pitch y is equal to six times the element pitch P, the reference distance, which is half the repeat pitch y, is equal to three times the element pitch P. However, if the repeat pitch y is an odd-number multiple of the element pitch P, e.g., seven times the element pitch P, the reference distance may be taken as being three or four times the element pitch P.

For the head 31*a* in FIG. 12, if the shortest distance in the width direction between each outlet in the target outlet row and each outlet in the reference outlet row is greater than the shortest distance in the width direction between each outlet in the intermediate outlet row and each outlet in the reference outlet row, the target outlet row may be other than the outlet row 315 and the intermediate outlet row may be other than the outlet row 313.

Although a plurality of outlets arranged in a row in the X direction perpendicular to the movement direction is taken as a single outlet row in the heads 31 and 31*a*, a plurality of outlets arranged in a direction that is perpendicular to the Z direction and slightly inclined with respect to the X direction may be taken as a single outlet row. In this case, a plurality of dots arranged in a row (i.e., dot row) in the width direction can be formed by setting different delay amounts for a plurality of outlets included in each outlet row. Note that in the ejection timing correction processing, the same set shift amount derived from the maximum density check region is added to the delay amounts for the respective outlets. As described above, it is sufficient for each outlet row to have a plurality of outlets arranged with a fixed outlet pitch in a direction intersecting the movement direction.

A plurality of heads in the head unit do not necessarily have to be disposed in a staggered manner along the width direction. For example, depending on the design of the inkjet printer, a plurality of heads may be arranged so as to be sequentially spaced apart from one another in the (+Y) direction as their positions move in the (−X) direction.

In the inkjet printer 1, the movement mechanism for moving the base material 9 in the movement direction relative to the head unit 3 is realized by the first motor part 21 and the second motor part 22, but depending on the design of the inkjet printer, a movement mechanism for moving the head unit in the Y direction may be provided.

Furthermore, a configuration is also possible in which the head unit is provided with only a single head, and an image is recorded on the entire base material by moving the head unit in both the X and Y directions relative to the base material. However, in order to record an image on the entire base material at high speed, it is preferable for the head unit to have a plurality of heads arranged across the width of a base material and realize so-called one-pass printing in which printing is completed in one pass of the base material under the head unit.

In the inkjet printer 1, the base material on which an image is to be recorded is not limited to a band-like material, and may, for example, be cut paper or a plate-like material such as a glass plate or a metal plate.

The configurations of the above-described preferred embodiments and variations may be appropriately combined as long as there are no mutual inconsistencies.

While the invention has been shown and described in detail, the foregoing description is in all aspects illustrative and not restrictive. It is therefore understood that numerous modifications and variations can be devised without departing from the scope of the invention. This application claims priority benefit under 35 U.S.C. Section 119 of Japanese Patent Application No. 2011-70616 filed in the Japan Patent Office on Mar. 28, 2011, the entire disclosure of which is incorporated herein by reference.

Reference Signs List

1 Inkjet printer
4 Control part
5 Density measurement part
9 Base material
21, 22 Motor part
31, 31*a* Head
41 Input receiving part
42 Ejection timing correction part
43 Region specification part
91 Check region
300 Outlet
311-318 Outlet row
910 Dot
911-913, 915 Dot row
S11-S15 Step
dy Set shift amount
x Outlet pitch
y Repeat pitch

The invention claimed is:

1. An inkjet printer comprising:

a head that ejects fine droplets of ink toward a base material;

a movement mechanism that moves said base material in a predetermined movement direction relative to said head; and a control part that controls ink ejection from said head, wherein said head includes a first outlet row and a second outlet row, each including a plurality of outlets arranged with a fixed outlet pitch in a direction that intersects said movement direction, said first outlet row and said second outlet row being arranged in said movement direction, each outlet in said second outlet row is disposed between each pair of adjacent outlets in said first outlet row with respect to a width direction perpendicular to said movement direction, uniform images are recorded in a plurality of check regions, each being a region of a predetermined size on said base material, under control of said control part, assuming that a plurality of dots arranged in said width direction is taken as a dot row in the uniform image in each check region, a combination of a first dot row formed with said first outlet row and a second dot row formed with said second outlet row while being spaced apart from said first dot row in said movement direction is repeatedly arranged with a fixed pitch in said movement direction, when the uniform image is recorded in said each check region, a distance that is obtained by changing a reference distance, which is half said pitch, by a set shift amount is assigned as a distance between said first dot row and said second dot row by said control part, said set shift amount being progressively changed for said plurality of check regions, in said plurality of check regions, an overlapping area of said first dot row and said second dot row varies depending on an actual shift amount of a distance between said first dot row and said second dot row from said reference distance, and said control part includes an input receiving part and an ejection timing correction part, said input receiving part receiving an input signal for specifying a maximum density check region that has a maximum dot area rate in the uniform image out of said plurality of check regions, and said ejection timing correction part correcting ejection timing of said second outlet row with respect to ejection timing of said first outlet row, based on a set shift amount corresponding to said maximum density check region.

2. The inkjet printer according to claim 1, further comprising:

a density measurement part that measures densities of said plurality of check regions; and a region specification part that specifies said maximum density check region based on a measurement result from said density measurement part, wherein said input receiving part receives a signal indicating said maximum density check region as said input signal, from said region specification part.

3. The inkjet printer according to claim 1, wherein said head further includes a third outlet row that is arranged together with said first outlet row and said second outlet row in said movement direction, each outlet in said second outlet row and each outlet in said third outlet row are disposed between each pair of adjacent outlets in said first outlet row with respect to said width direction, a shortest distance in said width direction between each outlet in said third outlet row and each outlet in said first outlet row is greater than a shortest distance in said width direction between each outlet in said second outlet row and each outlet in said first outlet row, said control part records uniform images in another plurality of check regions with said second outlet row and said third outlet row in the same manner as in said plurality of check regions, said input receiving part receives an input signal for specifying another maximum density check region out of said other plurality of check regions, and said ejection timing correction part corrects ejection timing of said third outlet row with respect to ejection timing of said first outlet row, based on the set shift amount corresponding to said maximum density check region and a set shift amount corresponding to said other maximum density check region.

4. The inkjet printer according to claim 2, wherein said head further includes a third outlet row that is arranged together with said first outlet row and said second outlet row in said movement direction, each outlet in said second outlet row and each outlet in said third outlet row are disposed between each pair of adjacent outlets in said first outlet row with respect to said width direction, a shortest distance in said width direction between each outlet in said third outlet row and each outlet in said first outlet row is greater than a shortest distance in said width direction between each outlet in said second outlet row and each outlet in said first outlet row, said control part records uniform images in another plurality of check regions with said second outlet row and said third outlet row in the same manner as in said plurality of check regions, said input receiving part receives an input signal for specifying another maximum density check region out of said other plurality of check regions, and said ejection timing correction part corrects ejection timing of said third outlet row with respect to ejection timing of said first outlet row, based on the set shift amount corresponding to said maximum density check region and a set shift amount corresponding to said other maximum density check region.

5. The inkjet printer according to claim 1, comprising:

a plurality of heads that include said head and are arranged across said base material in said width direction, said plurality of heads each having the same configuration as said head, wherein said input receiving part receives said input signal for each head, and said ejection timing correction part corrects said ejection timing of said second outlet row for said each head.

6. The inkjet printer according to claim 2, comprising:

a plurality of heads that include said head and are arranged across said base material in said width direction, said plurality of heads each having the same configuration as said head, wherein said input receiving part receives said input signal for each head, and said ejection timing correction part corrects said ejection timing of said second outlet row for said each head.

7. The inkjet printer according to claim 3, comprising:

a plurality of heads that include said head and are arranged across said base material in said width direction, said plurality of heads each having the same configuration as said head, wherein said input receiving part receives said input signal for each head, and said ejection timing correction part corrects said ejection timing of said second outlet row and said ejection timing of said third outlet row for said each head.

8. The inkjet printer according to claim 4, comprising:

a plurality of heads that include said head and are arranged across said base material in said width direction, said plurality of heads each having the same configuration as said head, wherein said input receiving part receives said input signal for each head, and said ejection timing correction part corrects said ejection timing of said second outlet row and said ejection timing of said third outlet row for said each head.

9. An ejection timing correction method used in an inkjet printer including a first outlet row and a second outlet row that are arranged in a predetermined movement direction, for correcting ejection timing of said second outlet row with respect to ejection timing of said first outlet row, said inkjet printer including:

a head that ejects fine droplets of ink toward a base material; and a movement mechanism that moves said base material in said movement direction relative to said head, wherein said head includes said first outlet row and said second outlet row, each including a plurality of outlets arranged with a fixed outlet pitch in a direction that intersects said movement direction, and each outlet in said second outlet row is disposed between each pair of adjacent outlets in said first outlet row with respect to a width direction perpendicular to said movement direction, said ejection timing correction method comprising the steps of:

a) with said movement mechanism, moving said base material in said movement direction relative to said head;

b) with said head, recording uniform images in a plurality of check regions, each being a region of a predetermined size on said base material, according a predetermined rule, said step b) being performed in parallel with said step a);

c) specifying a maximum density check region that has a maximum dot area rate in the uniform image, out of said plurality of check regions; and d) correcting ejection timing of said second outlet row with respect to ejection timing of said first outlet row based on said maximum density check region, wherein under said predetermined rule, assuming that a plurality of dots arranged in said width direction is taken as a dot row in the uniform image in each check region, a combination of a first dot row formed with said first outlet row and a second dot row formed with said second outlet row while being spaced apart from said first dot row in said movement direction is repeatedly arranged with a fixed pitch in said movement direction, and when the uniform image is recorded in said each check region, a distance that is obtained by changing a reference distance, which is half said pitch, by a set shift amount is assigned as a distance between said first dot row and said second dot row, said set shift amount being progressively changed for said plurality of check regions, in said plurality of check regions, an overlapping area of said first dot row and said second dot row varies depending on an actual shift amount of a distance between said first dot row and said second dot row from said reference distance, and in said step d), said ejection timing of said second outlet row is corrected based on a set shift amount corresponding to said maximum density check region.

10. The ejection timing correction method according to claim 9, wherein said head further includes a third outlet row that is arranged together with said first outlet row and said second outlet row in said movement direction, each outlet in said second outlet row and each outlet in said third outlet row are disposed between each pair of adjacent outlets in said first outlet row with respect to said width direction, a shortest distance in said width direction between each outlet in said third outlet row and each outlet in said first outlet row is greater than a shortest distance in said width direction between each outlet in said second outlet row and each outlet in said first outlet row, in said step b), uniform images are recorded in another plurality of check regions with said second outlet row and said third outlet row in the same manner as in said plurality of check regions, in said step c), another maximum density check region is specified out of said other plurality of check regions, and in said step d), ejection timing of said third outlet row with respect to ejection timing of said first outlet row is corrected based on the set shift amount corresponding to said maximum density check region and a set shift amount corresponding to said other maximum density check region.

11. The ejection timing correction method according to claim 9, wherein said inkjet printer includes a plurality of heads that include said head and are arranged across said base material in said width direction, said plurality of heads each having the same configuration as said head, and in said step d), said ejection timing of said second outlet row is corrected for each head.

12. The ejection timing correction method according to claim 10, wherein said inkjet printer includes a plurality of heads that include said head and are arranged across said base material in said width direction, said plurality of heads each having the same configuration as said head, and in said step d), said ejection timing of said second outlet row and said ejection timing of said third outlet row are corrected for each head.

* * * * *